US009431703B1

(12) United States Patent
Dandlberger et al.

(10) Patent No.: US 9,431,703 B1
(45) Date of Patent: Aug. 30, 2016

(54) DIFFERENTIAL PHASE SHIFTER ASSEMBLY

(71) Applicant: KATHREIN-WERKE KG, Rosenheim (DE)

(72) Inventors: Stephan Dandlberger, Rosenheim (DE); Georg Tischler, Stephanskirchen (DE)

(73) Assignee: KATHREIN-WERKE KG, Rosenheim (DE)

( * ) Notice: Subject to any disclaimer, the term of this patent is extended or adjusted under 35 U.S.C. 154(b) by 0 days.

(21) Appl. No.: 15/149,432

(22) Filed: May 9, 2016

(30) Foreign Application Priority Data

May 22, 2015 (DE) ..... 10 2015 006 622
Dec. 15, 2015 (DE) ..... 10 2015 121 799

(51) Int. Cl.
*H01P 1/18* (2006.01)
*H01Q 3/32* (2006.01)
*H01Q 21/00* (2006.01)
*H01Q 3/30* (2006.01)

(52) U.S. Cl.
CPC ..... *H01Q 3/32* (2013.01); *H01Q 3/30* (2013.01); *H01Q 21/00* (2013.01); *H01Q 21/0075* (2013.01)

(58) Field of Classification Search
CPC ..... H01Q 1/246; H01Q 3/30; H01Q 21/00; H01P 1/18
See application file for complete search history.

(56) References Cited

U.S. PATENT DOCUMENTS 6,850,130 B1 * 2/2005 Gottl ..... H01Q 3/32 333/156
7,907,096 B2 * 3/2011 Timofeev ..... H01Q 3/32 333/156
9,160,062 B2 * 10/2015 Goettl ..... H01Q 1/246
2008/0211600 A1 9/2008 Arderiu

FOREIGN PATENT DOCUMENTS

DE 101 04 564 9/2002
EP 1 208 614 9/2003
EP 1 870 959 12/2007

* cited by examiner

*Primary Examiner* — Hoang V Nguyen
(74) *Attorney, Agent, or Firm* — Nixon & Vanderhye P.C.

(57) ABSTRACT

A differential phase shifter assembly with n striplines positioned concentrically with one another, on the opposite stripline ends of which connecting points for connecting lines leading to radiators are provided, where n is a natural integer greater than or equal to 2. A feeding and/or tapping device is pivotable about a central and/or pivot axis, and is therefore pivotable over the plurality of striplines while establishing a primary capacitive coupling. A central feed serves to feed the feeding and/or tapping device. At least one to n−1 secondary capacitive couplings are additionally provided. The one or more secondary capacitive couplings are provided on the side of the feeding and/or tapping assembly facing the primary capacitive coupling. For the at least one additional secondary capacitive coupling, at least one additional branched feeding and/or tapping device is provided, which together with the feeding and/or tapping device is pivotable about the central and/or pivot axis.

14 Claims, 8 Drawing Sheets

DIFFERENTIAL PHASE SHIFTER ASSEMBLY

Figure 1:
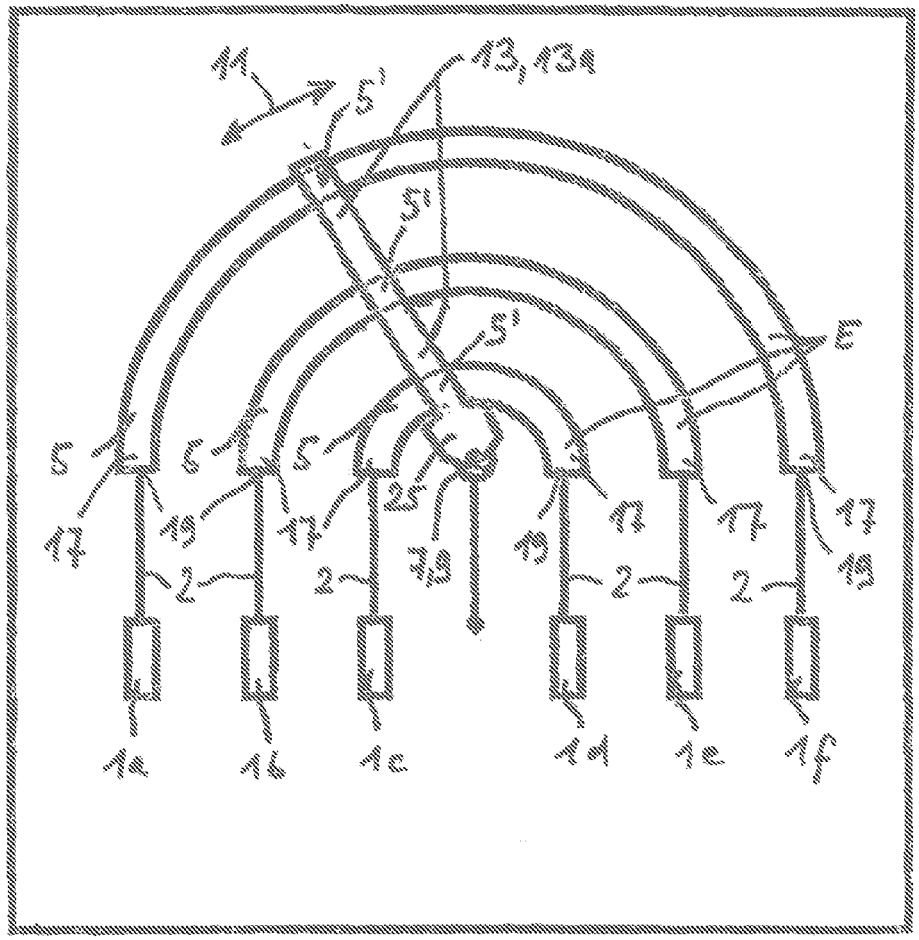

This application claims priority to DE Patent Application No. 10 2015 006 622.6 filed 22 May 2015, and DE Patent Application No. 10 2015 121 799.6 filed 15 Dec. 2015, the entire contents of each of which are hereby incorporated by reference.

The invention relates to a differential phase shifter assembly according to the preamble of claim 1.

In particular, the mobile radio antennas provided for a base station usually include an antenna arrangement with a reflector, in front of which are numerous radiator elements, vertically offset from one another, thus forming an array. These can transmit and receive, for example in one or two mutually perpendicular polarizations. The radiator elements can be developed for receiving in only one frequency band. However, the antenna arrangement can also be developed as a multi-band antenna, for example for sending and receiving in two frequency bands offset from one another. So-called tri-band antennas are also generally known.

It is known that the mobile radio network is of cellular design, where each cell is assigned a corresponding base station with at least one mobile radio antenna for sending and receiving. The antennas are so constructed in this case that they generally radiate at a particular angle with respect to the horizontal with a downwardly directed main lobe, a certain cell size being defined thereby. This tilt angle is also known to be called the down-tilt angle.

A type-defining differential phase shifter assembly is already known from EP 1 208 614 B1 or US 2008/0211600 A1, wherein, with a single-column antenna array with numerous vertically arranged radiators, the down-tilt angle can be separately adjusted continuously. According to this prior publication, differential phase shifters are used for this purpose, which ensure, with different adjustments, that the running times and thus the phase shift in the two outputs of a respective phase shifter are adjusted in different directions, the tilt angle being adjusted thereby.

The adjustment and shifting of the phase shifter angle can be carried out manually or by means of a remotely controlled retrofit unit, as is known for example from DE 101 04 564 C1.

The type-defining differential phase shifter assembly includes at least two concentrically arranged stripline sections. At the respective opposite ends of these stripline sections, connection points are provided at which connecting lines to different radiators of an antenna array (particularly a mobile radio antenna) can be connected.

The phase shifter assembly also includes a feeding or tapping element (which is hereafter sometimes designated as a feeding and/or tapping arm or device), which can be pivoted about a central and/or pivot axis, the pointer-shaped feeding or tapping element being pivotable back and forth over the multiple concentric striplines.

The individual striplines are usually mechanically held and anchored at their ends with respect to the conductive housing or the conductive housing shells, using insulators. In order to ensure a coupling distance as uniform as possible between the corresponding sections of the feeding or tapping element, on the one hand, and the respective sections of the striplines on the other hand, it has already been proposed to so equip a differential phase shifter assembly, basically known from EP 1 208 614 B1, that the pointer-shaped feeding or tapping element is designed to extend in a kind of fork from the rotation axis, so that a section of the feeding or tapping element extends on the one side over all the striplines up to a radially outward end, and a second section of the feeding or tapping element on the opposite side is led over all striplines up to an outer end, so that all striplines are virtually positioned in the fork- or pocket-shaped receptacle between the two parallel running sections of the feeding or tapping element. At the same time, the desired capacitive coupling between the feeding and/or tapping element and the corresponding overlaid section of the respective striplines is effected in these respectively overlapping areas, for which purpose an insulator is inserted between the two sections, arranged at a distance from one another, of the feeding and/or tapping element and the adjacent overlaid area of the respective stripline.

Furthermore, a functionally comparable solution to the previously explained construction is known, wherein a suitable fork-shaped branch is so accomplished when accommodating a section of the stripline, which for each stripline a separate fork-shaped branch is provided, forming an accommodation space for one stripline each. In other words, the mentioned feeding or tapping element (feeding or tapping arm) runs from the rotation axis along one side of all the striplines, a fork-shaped branch in every case preferably leading in front of each stripline into an overlying plane facing the rotation axis, so that between the fork-shaped branch on the one hand and the associated section of the feeding or tapping arm an accommodation space is produced in which the corresponding stripline section is located. Above the insulation layer lying in between them, a galvanic separation from the electrically conductive sections of the feeding or tapping elements on the one hand and from the associated fork-shaped branched section on the other hand is ensured in every case.

A corresponding construction is also obtainable from EP 1 870 959 B1.

In order to achieve a certain power distribution with respect to the different striplines, it is additionally proposed (even if this is only possible to a limited degree) in EP 1 208 614 B1 to provide the feeding or tapping element with different width extensions (parallel to the plane of the stripline) at various radially situated locations.

In this respect, the object of the present invention is to provide an improved phase shifter assembly.

The object is accomplished according to the invention by means of the features given in claim 1. Advantageous embodiments of the invention are shown in the subclaims.

It should be considered quite surprising that a greatly improved power distribution with respect to the different striplines is possible with comparatively simple means compared to prior solutions. In particular, however, the invention does offer the possibility of obtaining an improved power distribution in a targeted manner.

According to the invention, this is accomplished in that the pockets, described for example in EP 1 208 614 B1, which are formed by a fork-shaped design of a respective section of the feeding or tapping device are not provided for all striplines, but, rather, at least only for one stripline, or at least only for n−1 striplines at most, if the phase shifter assembly includes n striplines.

In a preferred embodiment, it is possible for a pocket-shaped design to be provided using a fork-shaped branch, for example only for the stripline closest to the rotation axis, and thus innermost.

It is also possible for the branched feeding and/or tapping device (hereafter also sometimes called branched feeding and/or tapping element or arm) additionally formed by the branch to have an elongated design, and for example guided over two or three striplines spaced in parallel to the feeding and/or tapping arm overlying all the striplines, so that, for example, one of the third or fourth or farther outlying stripline sections remote from the rotation axis is not overlaid by the branched section.

By this construction it is ensured that, for the striplines additionally overlaid by the branched section, for example a roughly 100% larger coupling surface can be formed, so that in these areas with a significantly increased coupling surface a correspondingly greater power share can also then be transferred to the individual striplines or from the striplines to the central power supply network.

Instead of a branched section which runs over at least two or more striplines, a separate fork-shaped branched section can also be provided for each of the striplines to be correspondingly supplied with larger power shares, whereby ultimately a capacitive coupling is established on both sides of an associated stripline, thus allowing an increased power transfer.

The last-named variant offers the advantage that for arbitrary striplines a respective associated branched feeding and/or tapping device can be provided, which therefore need not always include the inmost situated stripline(s). This is because these additional separate branched feeding and/or tapping devices can, for example, also be provided selectively only to a second and/or third and/or fourth, etc., stripline.

Generally, therefore, the power distribution can be adjusted for the shape and/or geometry of the respective acceptor, i.e., the respective coupling device. Thus, within the scope of the invention, an adjustment of the power distribution to different striplines is made possible by different coupling situations.

These different coupling situations can be accomplished, for example, by suitable combinations, wherein for example at particular striplines only one single-sided coupling is formed, while on the other hand, at other selectively determinable striplines, a two-sided coupling is implemented.

In other words, a considerably higher power distribution is therefore achievable due to the previously explained possible combination of the two coupling concepts. This variant offers significant advantages compared to the prior art, which up to this point only allowed one possible power distribution, in that the associated feeding and/or tapping arm overlying all the striplines was altered by having a different material thickness and/or extent in the area of the coupling sections as well as the area located between them. With these existing concepts, however, the desired power distribution is limited by the minimum necessary mechanical specification and dimensions with regard to the feeding and/or tapping arm. On the other hand, with the same basic mechanical dimensions with regard to the branched feeding and/or tapping device compared with the feeding and/or tapping arm overlying all striplines, an increase in the power distribution by 2 dB, for example, is possible, which was not achievable until now.

In an additional preferred embodiment or variant of the invention it is also possible to provide an additional branched feeding and/or tapping device for the one or more additional secondary capacitive couplings, which is so constructed that adjacent to the rotation axis not only is an additional capacitive coupling formed at the innermost stripline or additionally at another subsequent stripline, but, rather, the additional capacitive coupling can be assigned to any desired stripline. In other words, it is preferred to provide so-called capacitive-free or low-capacitance zones between the pivot axis, or a stripline closer to the pivot axis, and an outer stripline more remote from it, in which zones the additional branched feeding and/or tapping device runs, but in which no or no relevant secondary capacitive coupling is established.

Figure 2:
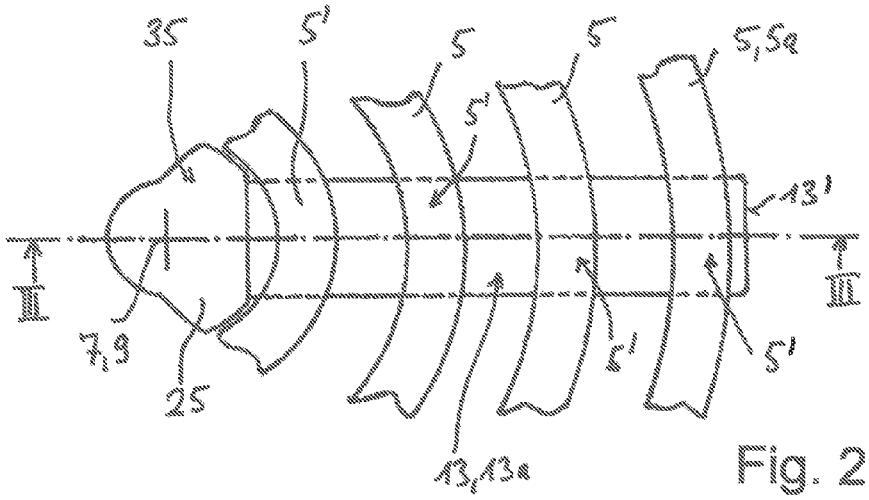
Figure 3:
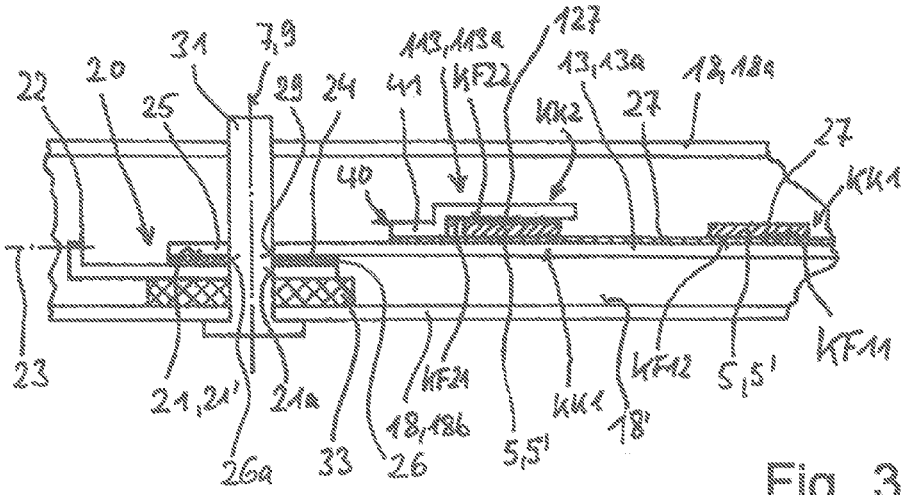
Figure 3A:
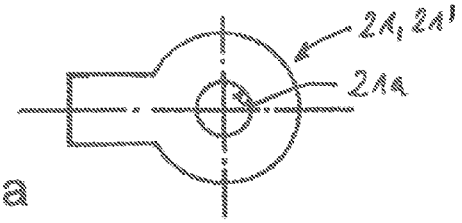
Figure 4A:
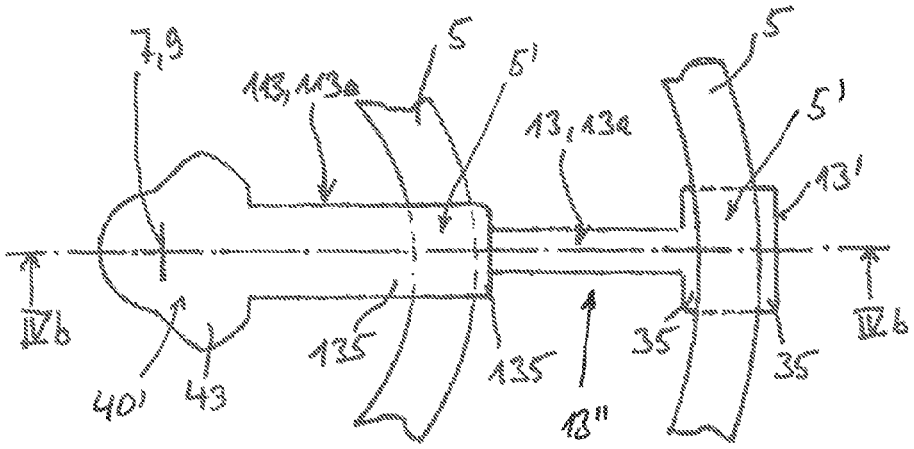
Figure 4B:
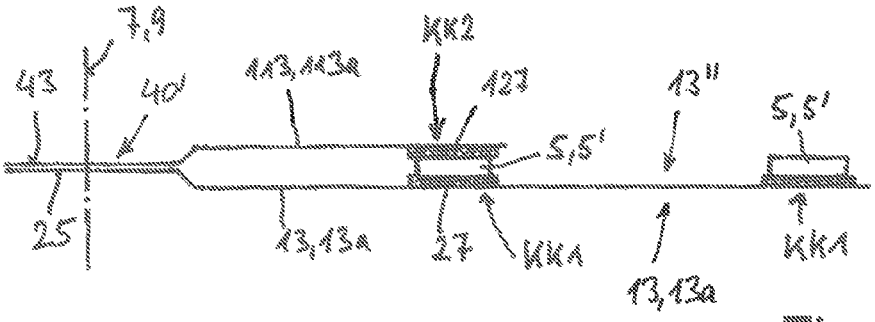

The invention will be explained hereafter in more detail using different exemplary embodiments. Shown in detail are the following:

FIG. 1: a schematic plan view of a differential phase shifter assembly according to the invention, with the housing cover removed and/or half of the housing removed;

FIG. 2: a partial enlarged detail view of the feeding and/or tapping element shown in FIG. 1 and a corresponding detail of the corresponding striplines;

FIG. 3: a cross-sectional view in the longitudinal direction of the feeding and/or tapping element along line III-III in FIG. 2 with regard to a first exemplary embodiment expanded with respect to FIG. 2;

FIG. 3*a*: an enlarged detail view relating to the feed;

FIG. 4*a*: a plan view of a first exemplary embodiment according to the invention relating to a differential phase shifter assembly with only two striplines;

FIG. 4*b*: a cross-sectional view along line IVb-IVb in FIG. 4*a;*

Figure 5:
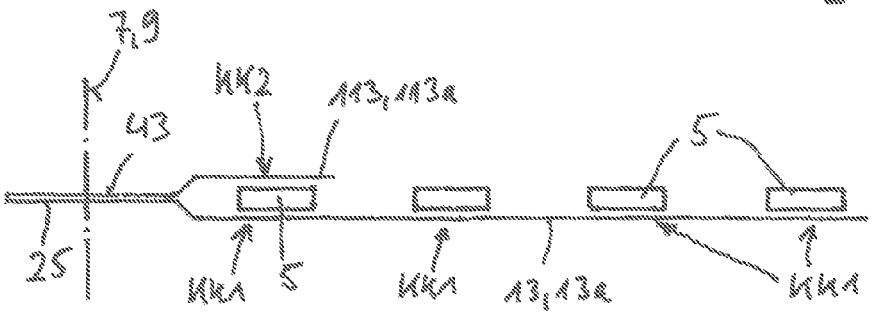
Figure 14:
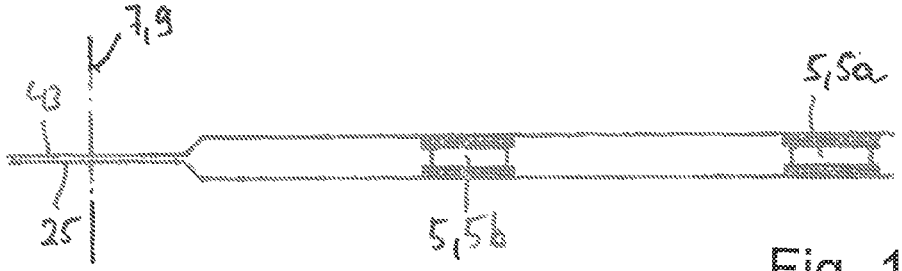
Figure 15:
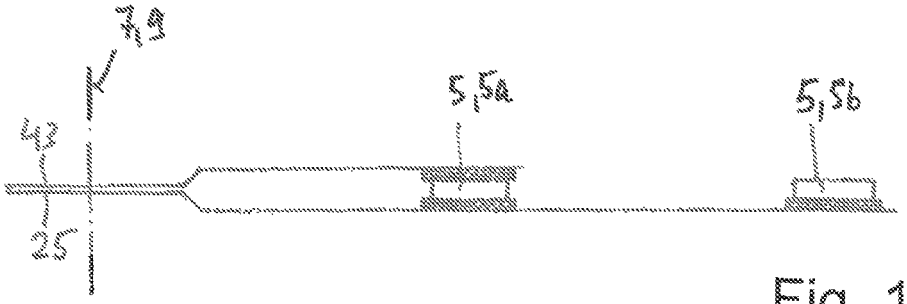
Figure 12:
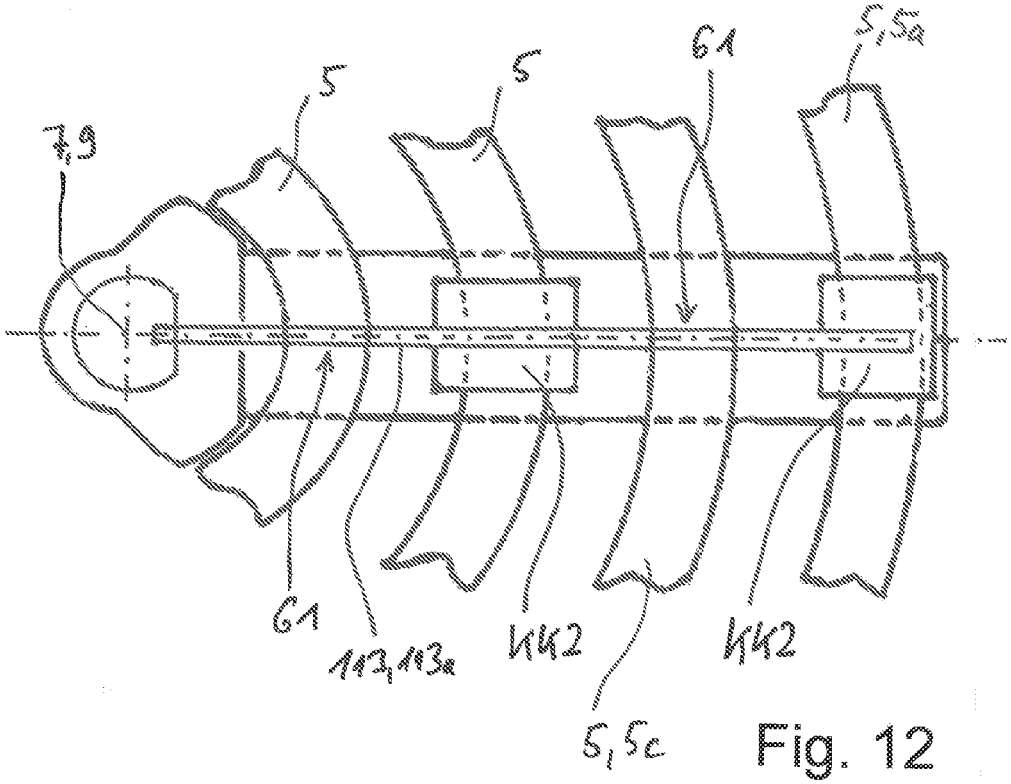
Figure 13:
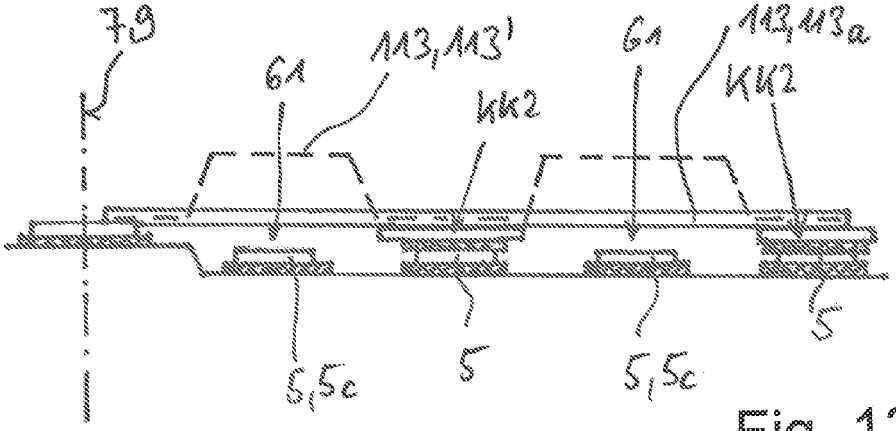

FIG. 5: a schematic cross-sectional view of FIG. 4*b*, but relating to a different exemplary embodiment;

FIGS. 6 to 11: additional different modified exemplary embodiments in schematic cross-sectional views, similar to the example in FIG. 5;

FIG. 12: a modified exemplary embodiment in plan view;

FIG. 13: a cross-sectional view of the modified exemplary embodiment according to the invention shown in FIG. 12;

FIG. 14: a simplified cross-sectional view of a differential phase shifter known in the prior art with two circular arc striplines;

FIG. 15: an embodiment according to the invention with two circular arc striplines, as already basically shown in FIGS. 4*a*, 4*b;*

Figure 16:
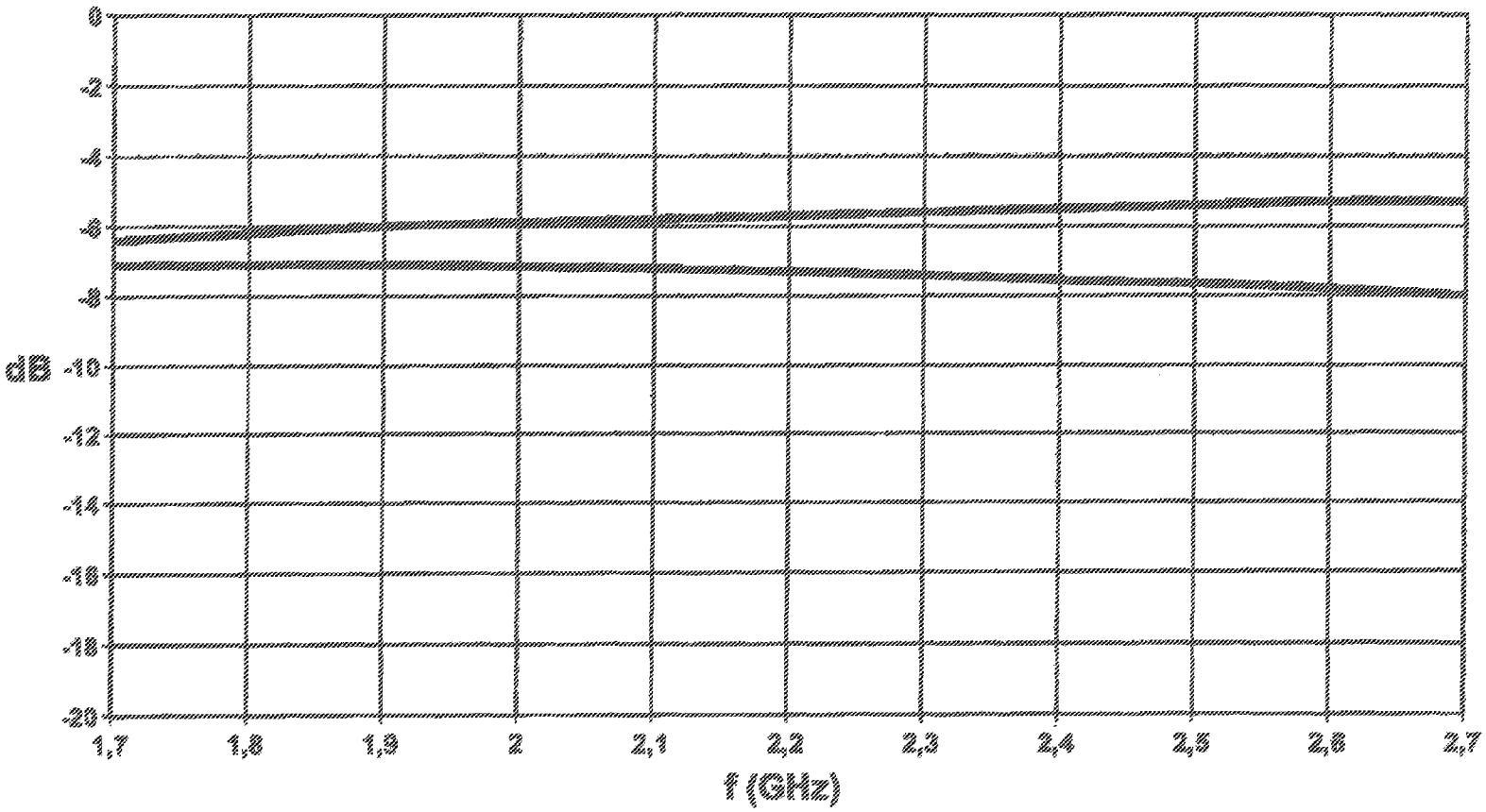
Figure 17:
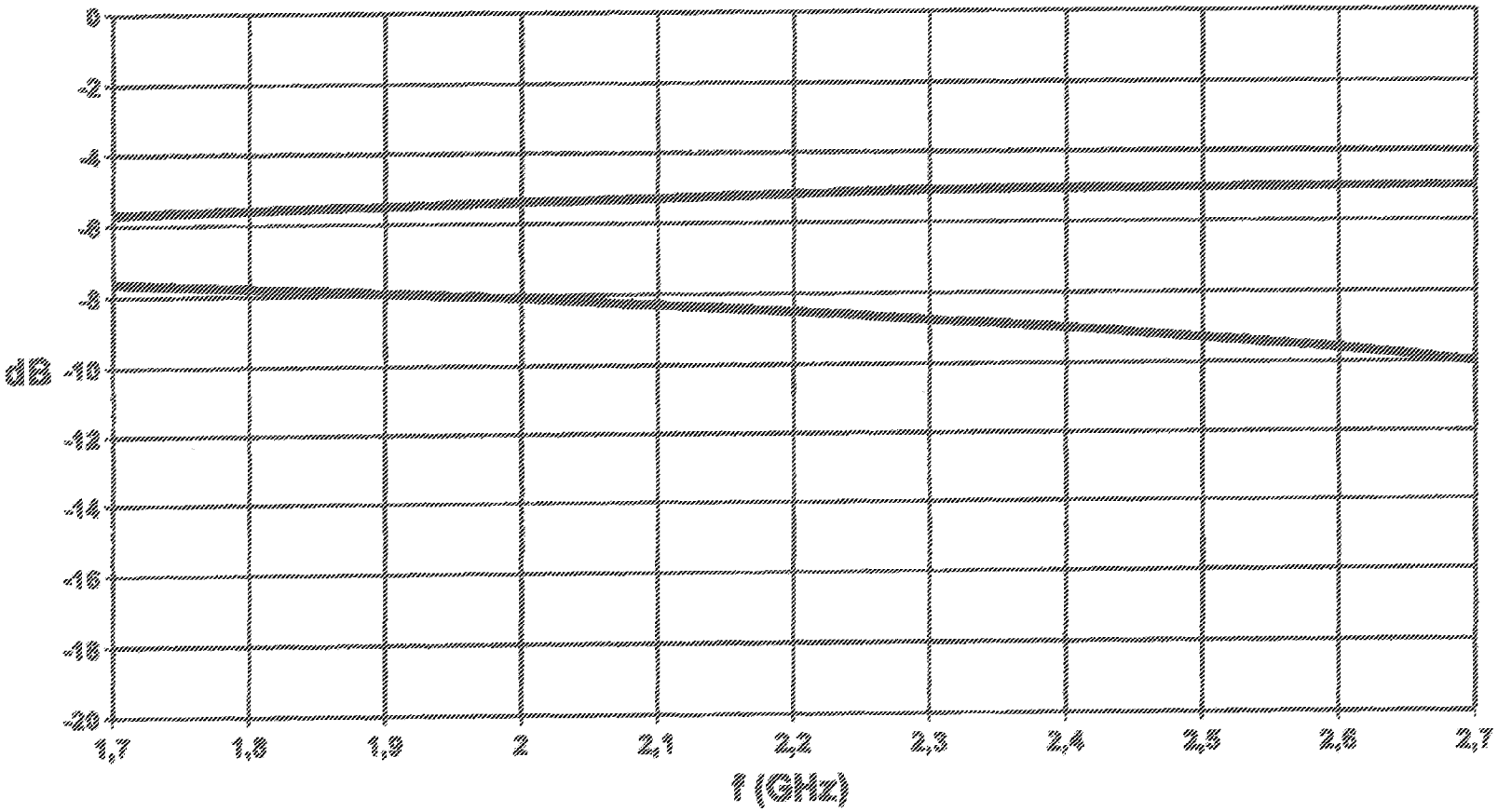

FIG. 16: a diagram for elucidating a maximum possible power distribution in a differential phase shifter assembly according to the prior art, as shown in FIG. 14; and FIG. 17: a corresponding view using a diagram for clarifying an improved power distribution for the various striplines, as achievable for example in a variant of the invention according to FIG. 15.

FIG. 1 depicts a plan view of a schematic illustration of the phase shifter assembly according to the invention, with the housing cover removed or half of the housing removed.

From this it can be seen that according to this exemplary embodiment, the differential phase shifter assembly includes three circular arc striplines 5 which are arranged concentrically with respect to a center 7. The striplines 5 are usually arranged in a common plane E. The striplines must not necessarily be half-circular in shape, but rather can also have a circular arc of more than 180°. In general, the striplines 5 have a length with which they only enclose an arc of less than 180°.

A central or pivot axis 9 about which a lever-, finger-, arm- and/or pointer-shaped feeding and/or tapping device 13 corresponding to the double arrow view 11 can be pivoted runs perpendicular to the plane of the drawing, and thus perpendicular to the plane E in which the striplines 5 lie. The feeding and/or tapping device 13 mentioned includes for this purpose a suitable feeding and/or tapping element 13*a* which runs on one side of the striplines over all striplines, thus intersecting the striplines and respectively overlying them with a suitable coupling section.

A primary capacitive coupling KK1 is established in known fashion in each case between the feeding and/or tapping element 13*a* and each of the striplines 5, and is established in the overlapping area between a section of the feeding and/or tapping element 13*a* on the one hand and the section 5' of the stripline 5 respectively overlying it.

For this purpose, the feeding and/or tapping element 13*a* is arranged running from the inward central or pivot axis over the striplines 5, including the outermost striplines 5. The end 13' of the corresponding feeding and/or tapping element 13*a* usually also overlies at least the outer edge of the outermost stripline 5*a*. A first coupling surface KF11 of the feeding and/or tapping element 13*a* overlies a section of the stripline located a distance away from it, which is also designated as a second primary coupling surface KF12. Between these first and second primary coupling surfaces KF11, KF12 is located an insulator or dielectric 27, generally not in the form of air, but rather in the form of a solid material. This insulator 27 is usually affixed or anchored to the feeding and/or tapping element 13*a* and pivots with it. The so-called primary capacitive coupling KK1 between the feeding and/or tapping element 13 and the respective stripline 5 cooperating with it is thus established in the overlying area due to these two cooperating first and second primary coupling surfaces KF11, KF12.

By suitable pivoting of the pointer-shaped feeding and/or tapping arm 13*a*, the respective path length between a stripline coupling section 5' of a stripline 5 and the respective remaining stripline end 17 is increased or reduced with respect to the opposite stripline section, thus changing the run time of the signals in the opposite direction in a known fashion. For example, a down-tilt angle of attached radiators can be adjusted differently in this way. For this purpose, connecting lines 2 which lead to the individual radiators 1*a* through 1*f* and which are only indicated in the drawings are connected to the stripline ends 17 at the connection points 19 formed there.

On the basis of FIG. 2, an enlarged detail section of the feeding and/or tapping device 13 is shown, namely, with the already mentioned feeding and/or tapping arm 13*a*, which can be adjusted about a central axis 9 over the striplines 5 generally up to the stripline ends 17. In the exemplary embodiments explained hereafter, for example four concentric striplines 5 are provided, which are shown only partially in the plan view according to FIG. 2, the branched feeding and/or tapping device according to the invention, recognizable hereafter in the cross-sectional view of FIG. 3, is not yet shown in the schematic plan view according to FIG. 2.

FIG. 3 shows a cross-sectional view along line III-III in FIG. 2, but with a branched feeding and/or tapping device additionally provided within the scope of the invention according to a first variant of the invention. The feeding of the feeding and/or tapping arm 13*a* is accomplished in the area of the central or pivot axis 9.

For this purpose—as can also be seen in particular in the cross-sectional view of FIG. 3—in the area of the central and pivot axis 9 a central feed 20 with a first coupling device or coupling surface 21 is provided, which is connected to a central feed line 23 via a coupling connection 22 (FIG. 3).

An indicator head 25 of the feeding and/or tapping arm 13*a* is offset with respect to this first coupling surface 21 (which hereafter is also designated as a feed line-side coupling surface 21) in the direction of the central or pivot axis 7, 9, generally with a dielectric or insulator 26 connected in between.

The feed line-side coupling surface 21 is preferably designed as a coupling ring 21' with a recess 21*a* (FIG. 3*a*). In addition, the indicator head 25 which forms the pointer- or tapping arm-side second coupling surface 24 generally has a central recess 29, and the dielectric 26 has a recess 26*a* through which runs an axial body 31 which forms the pivot axis and carries the pointer or tapping arm 13*a*, and which is made of an insulating plastic to avoid a galvanic connection.

The entire arrangement is generally likewise mechanically held and anchored by an insulator 33, which forms a base, on the inside 18' of the housing 18, i.e., the at least one-half housing 18*a*.

In order to now specifically provide, for example, a different power distribution for specific striplines, in the exemplary embodiment according to FIG. 3 a branched device 113 is provided which in the exemplary embodiment shown is connected, usually galvanically but possibly also capacitively, to the actual feeding and/or tapping arm 13*a*, namely, preferably at a holding section 40 located nearer to the central and/or pivot axis 9. A secondary capacitive coupling KK2 is ultimately achieved which includes a first secondary coupling surface KF21 and a second coupling surface K22, which will be discussed hereafter.

This branched feeding and/or tapping device 113 with the shown branched feeding and/or tapping element or arm 113*a* now overlies with its corresponding first secondary coupling surface KF21 a corresponding section, i.e., a corresponding second secondary coupling surface KF22 on the associated stripline 5, namely, on the side opposite the actual feeding and/or tapping arm 13*a*. The mentioned secondary capacitive coupling KK2 is thereby formed, namely, likewise once again preferably with a fixed dielectric or insulator 127 connected in between. This insulator 127 is preferably affixed to and/or formed on the branched feeding and/or tapping arm 113*a* and is movable along with it. The height or thickness of this insulator 127 on the opposite side between the strip element and the actual feeding and/or tapping element 13*a* usually corresponds to the clear distance between the respective coupling surfaces KF21 and KF22. Likewise, as a rule an insulator 27 relating to the primary capacitive coupling KK1 is provided, the thickness thereof corresponding to the distance between the first primary coupling surface KF11 and the second primary coupling surface KF22. This insulator 27 is usually applied to the feeding and/or tapping element 13 and held so as to pivot with it, also continuously if necessary over one or more of the striplines, as can be seen in the sectional view of FIG. 3.

With reference to the schematic plan view in FIG. 4*a* and the schematic cross-sectional view in FIG. 4*b*, for a phase shifter assembly including two concentric striplines it is shown only by way of example that the strengthened and improved power distribution according to the invention is yet further improved if, for the feeding and/or tapping device 13 which overlies all the striplines 5, between the two coupling sections relating to the two striplines 5 the associated feeding and/or tapping arm 13*a* has a line section 13" which has a tapered, narrower material section compared to the coupling sections, particularly running transverse to the direction of extension. This minimal transverse extent should generally not be below 4.0 mm so as to maintain sufficient mechanical stability or stiffness. From the plan view of FIG. 4*a* it can be seen that, for example, the primary coupling area between the first feeding and/or coupling arm 13*a* and the outer as well as the inner stripline 5 is wider in the pivot direction than is the width of a line section 13" located between them. Likewise, in the area of the secondary capacitive coupling, the second feeding and/or tapping device 113 provided for the inner stripline 5 is wider than the mentioned line section 13" between the two coupling areas of the primary feeding and/or tapping element 13*a*. Both the primary and the secondary capacitive couplings KK1, KK2 can have coupling areas which in their width extension, that is, corresponding to the pivot direction 11, are of the same or similar size or are even differently dimensioned.

In the variant according to FIG. 5, four striplines are provided, so that n=4, and at least one, i.e., in this case the innermost, stripline, is equipped with the additional second coupling device in the form of the branched feeding and/or tapping element 113.

Figure 6:
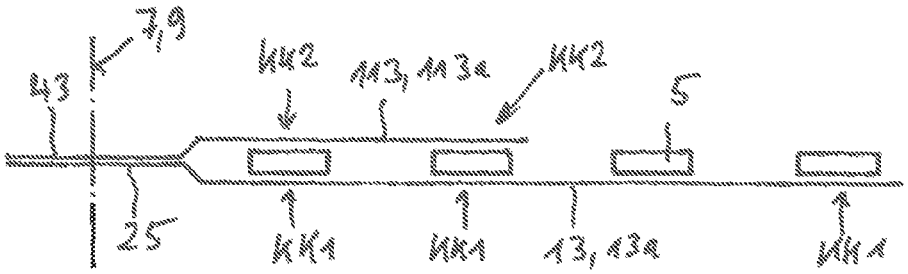

In the variant of FIG. 6, a cross-sectional view is rendered which is similar to the variant of FIG. 5, the branched feeding and/or tapping element 113*a*, however, being designed with a larger radial longitudinal extent, and hence overlying not only the innermost first stripline 5 on the side opposite the feeding and/or tapping arm 13, but also the second stripline 5 more distant from it, and here as well establishing an additional capacitive coupling in this second stripline 5. Both interior striplines 5 hereby obtain a greater power share. A suitable insulator is usually provided in each of these additional branched feeding and/or tapping elements 113*a* at the corresponding first secondary coupling surface KF21, which during pivoting of the feeding and/or tapping element 13*a* over the striplines on their surfaces, is pivotable while remaining in contact with this surface. If necessary, however, the additional installation of such an insulator 127 can be forgone in one case or another if a suitable insulator 127 is provided, for example at an adjacent secondary capacitive coupling and/or an adjacent stripline. Similarly, the insulators 27 are usually provided on the feeding and/or tapping arm 13, which are not illustrated in FIGS. 6 through 11.

Figure 7:
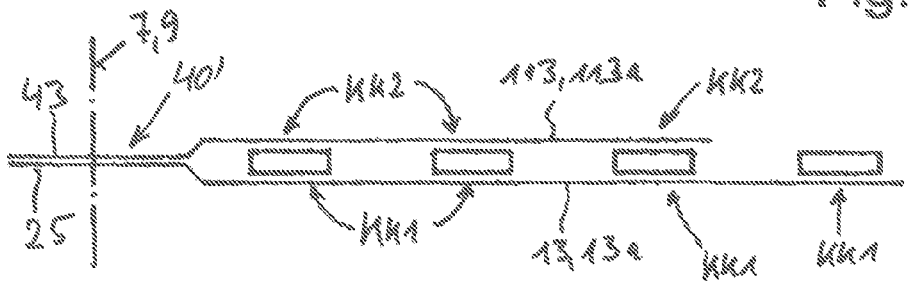

In the variant of FIG. 7, this arm 113*a* reaches to the penultimate stripline 5 counting from the inside, so that only the outermost, that is, the nth, stripline 5 is not equipped with an additional second coupling device, and for that reason a lower power share is allocated to it.

The depicted construction is valid basically independently of whether the number n of striplines is larger or smaller than the four striplines shown in the explained exemplary embodiment.

What matters here, contrary to the prior art, is that at least the one or the plurality of striplines 5, which are not intended to be allocated a higher power share, are not equipped with a corresponding branched feeding and/or tapping device. This principle of the invention applies basically independently of how many striplines the phase shifter assembly includes. This principle of the invention can be used if a phase shifter assembly—as explained—includes at least two striplines in particular concentrically positioned next to one another, to which a stated feeding and/or tapping device as well as a suitable branched feeding and/or tapping device are allocated.

However, a higher power share can also be allocated to individual or multiple striplines in a targeted manner due to another implementation of the invention.

Figure 8:
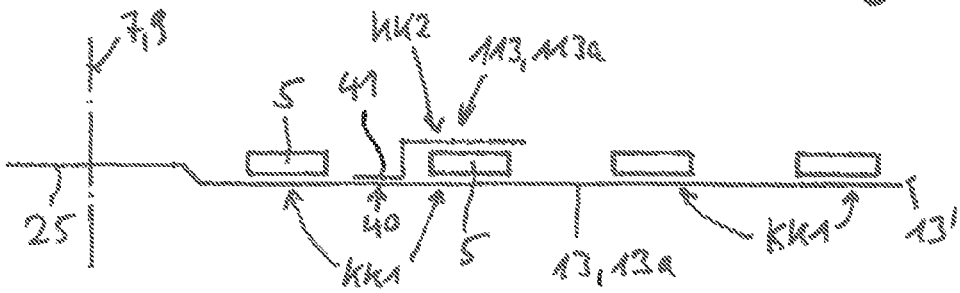

In the variant of FIG. 8, likewise also for a differential phase shifter with four striplines 5, it is shown, for example, that only the second stripline, for example, needs to be supplied with a higher power share.

For this purpose, a suitable branched feeding and/or tapping device 113 is provided which is connected here, generally galvanically, possibly also capacitively, to the corresponding section between the first and second striplines 5 on the feeding or tapping arm 13*a* running on one side of the striplines, and is mechanically held by means of an angular attachment 41, and for that reason is pivotable together with the feeding and/or tapping element 13.

This additional second branched feeding and/or tapping device 113 is so constructed that, for example, it additionally overlies only the second stripline measured from the pivot axis 9 on the side opposite the feeding and/or tapping element 13*a*, and allocates a larger power share to this second stripline.

Figure 9:
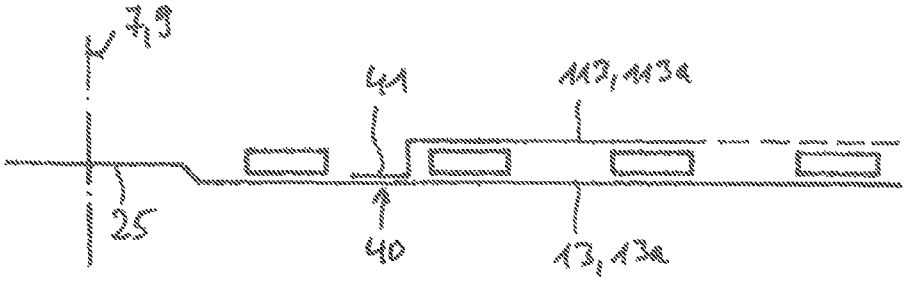

In the variant of FIG. 9, the corresponding branched feeding and/or tapping device 113, unlike in FIG. 7, is of extended construction and overlies not only the second stripline 5, viewed from the pivot axis, but also the third stripline 5. It is indicated there in dashes that the mentioned branched feeding and/or tapping device 113 could also again be constructed extending in the radial direction, and also provides a further additional secondary coupling device for the outermost, i.e., the nth, stripline 5.

Figure 10:
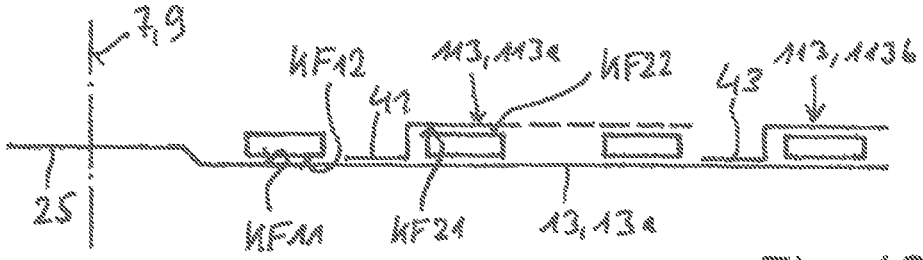

However, unlike in FIG. 9, the corresponding capacitive coupling devices can also be so formed according to FIG. 10 that one or more additional branched feeding and/or tapping elements 113*a*, 113*b*, and so forth are provided.

For example, at least one of the at least two additionally provided branched feeding and/or tapping elements 113*a*, 113*b*, and so forth can each overlie only a single stripline 5 and be capacitively coupled via it. However, it would also be possible for one of more of the branched feeding and/or tapping elements 113*a*, 113*b*, and so forth to overlie, for example, two or more striplines positioned next to one another, and thus be capacitively coupled. Within the scope of the construction according to the invention, it is necessary only that the additional branched feeding and/or tapping device 113 provided is only provided for at least one, and at most n−1, striplines, for which purpose individual striplines can be allocated an increased power share in a targeted manner.

Figure 11:
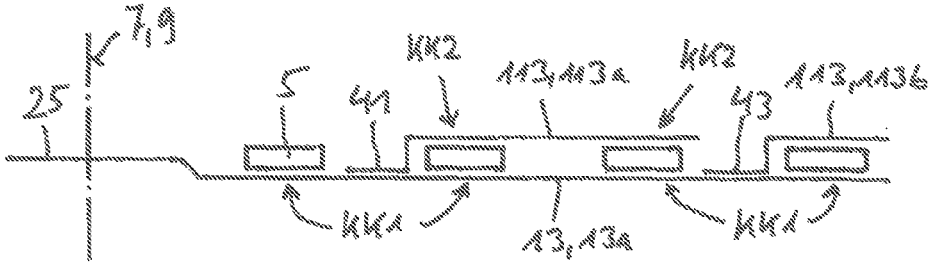

In the variant according to FIG. 11, one of the two separate branched feeding and/or tapping arms 113, for example the one closer to the central axis 9, is of extended construction, so that its branched feeding and/or tapping arm 113*a* overlies two striplines located next to one another, namely, the second or third striplines measured from the central axis, and thus allocates a second coupling arrangement and therefore a coupling surface for increasing the power transfer, whereas the branched feeding and/or tapping arm 113*b* allocated to the outermost stripline, that is, the nth stripline, is of shortened construction and is allocated only to this outermost stripline 5.

As a result of the depicted construction, due to the solution according to the invention one or more striplines 5, which are arbitrarily determinable, can be allocated an additional coupling surface, and thus a coupling device, in a targeted manner for increasing the power branching.

The corresponding coupling surfaces KF11, KF12 and/or KF21, KF22 which achieve the capacitive coupling can also be provided with coupling attachments 35 protruding in the pivot direction, first on their own feeding and/or tapping arm 13 but also on the branched feeding and/or tapping arms 113*a*, 113*b*, and so forth, as shown only by way of example in the modified plan view of FIG. 4*a* for a modified exemplary embodiment including only two striplines.

In the variant according to FIG. 4*a*, for example the feeding and/or tapping arm 13*a* which sweeps over all the striplines 5 relating to the outermost stripline, i.e., in the exemplary embodiment shown, relating to the second stripline 5 counting from the inside, is provided with coupling attachments 35 which protrude laterally in the pivot direction, as the result of which the coupling surface of this stripline 5 is also enlarged.

Regarding the inner first stripline 5, the feeding and/or tapping arm 13*a* cannot be equipped with coupling attachments 35 of this type, or cannot be equipped with comparably sized radially protruding coupling attachments 35. However, it is also possible that the coupling attachments 35 are even larger than, the same size as, or smaller than the corresponding coupling attachments 135 on the additionally provided at least one branched feeding and/or tapping device 113. Any desired different dimensioning is also possible at each provided primary and/or capacitive coupling KK1 and/or KK2.

Due to the mentioned differently dimensioned coupling attachments 35, which usually protrude in the pivot direction over the line sections 13" and/or 113" located between two couplings KK1-KK1 or KK2-KK2, an even further additional fine tuning relating to the power distribution can be undertaken. This additional fine tuning relating to the power distribution can be even further developed by designing the line section 13" between two adjacent primary capacitive couplings with a reduced or increased line cross-section, as described by means of the exemplary embodiment of FIGS. 4*a* and 4*b*. This also applies for a branched feeding and/or tapping device 113, if it is equipped with at least two secondary capacitive couplings KK2, that is, overlying at least two adjacent striplines 5 and capacitively coupled with them. Here as well, a line section 113" between two adjacent capacitive couplings KK2 can have an enlarged or a reduced material cross section if necessary, at least in relation to the actual coupling surfaces, whereby the adjacent striplines are allocated different power shares within the scope of the secondary capacitive coupling KK2.

Thus, as a result of the depicted construction, a different power distribution relating to different striplines can be carried out due to an arbitrary combination of two different capacitive coupling concepts. The different coupling concepts include, on the one hand, that particular striplines only have a simple capacitive coupling to the feeding and/or tapping element 13*a*, whereas on the other hand at least one to a maximum of n-striplines additionally has/have another capacitive coupling device, namely, in the form of an additionally provided branched feeding and/or tapping device 113, which is positioned opposite to the feeding and/or tapping arm 13*a* with respect to the respective stripline.

This additional branched feeding and/or tapping device 113 can, for example, be anchored on the actual feeding and/or tapping element or arm or device via an angular attachment adjacent to an associated stripline 5. This angular attachment 41 with the associated first secondary coupling surface KF21 is preferably galvanically, possibly also capacitively, connected and coupled to the feeding and/or tapping element 13*a* carrying it. The corresponding mounting and holding area 40 for the angular attachment 41 is thereby preferably referenced to an associated stripline 5 (with which the capacitive coupling is to be effected) on the side closer to the central and/or pivot axis 7, 9, but could also be positioned on the opposite side of the respective stripline 5 (also referring to the associated stripline 5 most distant from the pivot axis) on the feeding and/or tapping arm 13*a* running parallel to it, held there and pivotable with it.

In the case in which the branched feeding and/or tapping device 113 overlies only the innermost stripline or only a plurality of interior striplines which are therefore closer to the central and/or pivoting axis 9, and effects a capacitive coupling in each case here, it is also possible that the branched feeding and/or tapping device 113 on the side facing the pivot axis 7, 9 is not, or is not directly mounted, and held on, and thus electrically connected to, the feeding and/or tapping element 13*a*. In this case the feeding and/or tapping devices 113, with their mounting and holding area 40', which can be constructed here in the manner of an indicator head 43, can thus be directly anchored and supported on the axis body 31. With a co-rotating axis body 31, the entire feeding and/or tapping element 13*a* is then pivoted with the associated branched feeding and/or tapping device 113, or both of the indicator heads 25, 43 located in the area of the pivot axis 9 are mechanically connected and coupled for carrying out a shared pivoting motion.

It has already been mentioned that the branched feeding and/or tapping device 113 can, for example, have a holding attachment 41 by which it is held and situated on the feeding and/or tapping device 13. The feeding and coupling can occur here galvanically or capacitively. The same then also applies if the feeding and/or tapping device 113 is held by an indicator head 43, as is shown for example by FIGS. 4*a*, 4*b* or also FIGS. 5 through 7. It can generally be noted that the larger the coupling areas which cooperate here, the larger the coupling between the holding attachment 41 and the feeding and/or tapping device 13 and/or the indicator head 43 and the indicator head 25 of the feeding and/or tapping device.

With reference to the schematic plan view of FIG. 12 and the schematic cross-sectional view of FIG. 13, a modification of the previous exemplary embodiments is shown in that here, for example, an additional branched feeding and/or tapping device 113*a* is shown extending from an indicator head 43 in the area of the pivot axis 7, 9 and leading up to the outermost stripline 5, 5*a*. In this exemplary embodiment, a plurality of additional secondary capacitive couplings KK2 is held and carried by means of this additional branched feeding and/or tapping device 113, 113*a* (similarly to FIG. 6 and FIG. 7, for example), whereby, however, in a departure therefrom, the two additional secondary capacitive couplings KK2 provided in the exemplary embodiment of FIG. 12 and FIG. 13 are allocated not to two adjacent striplines 5, but, rather, to two more remote striplines 5, namely, with the interconnection of a stripline 5, 5*c* which is provided without an additional secondary capacitive coupling KK2. In this respect a coupling-free or minimally coupled zone 61 is formed here, because no coupling surfaces KF21, KF22 are provided with suitable dimensioning here. Only the branched feeding and/or tapping arrangement 113 carrying the coupling device KK2 itself is guided at a distance over the penultimate stripline 5 in this exemplary embodiment, for example without a fixed dielectric or insulator. The additional branched feeding and/or tapping device 113 is designed to be so narrow that virtually no effective coupling area is produced thereby with respect to the stripline which crosses it at a distance.

It can be seen in the plan view of FIG. 12 that, for example, the width of this additional branched feeding and/or tapping device 113 is preferably considerably smaller than 50%, particularly smaller than 40%, 30%, 20% and if necessary even smaller than 10%, of the width of the primary feeding and/or tapping device 13.

This opens the possibility of thus allocating coupling devices KK2 to arbitrary striplines by means of a single pointer-like branched feeding and/or tapping device 113, as no coupling device need be provided between two coupling devices of this type or even between the one feeding point in the area of the indicator head 43 and a first coupling device KK2, as is also accomplished in the variant of FIG.

12 and FIG. 13 (because the innermost stripline 5 here also has a coupling-free or minimally coupled zone 61, which is crossed at a distance therefrom only by the narrow additional branched feeding and/or tapping device).

In the cross-sectional view of FIG. 13, it is indicated in dashes that the additional branched feeding and/or tapping device 113 does not necessarily have to run in a plane, but, rather, that the additional branched feeding and/or tapping device 113 can have tilted or curved sections, especially in the coupling-free or minimally coupled zones 61, which are so constructed that the distance D between the lower side of the additional branched feeding and/or tapping device 113' and the upper side of the stripline 5 crossing below it is further enlarged, whereby purely theoretical small coupling effects are yet further reduced.

The advantages which are achievable according to the invention are briefly presented hereafter.

A simplified cross-sectional view for a differential phase shifter assembly as is known from the prior art is shown in FIG. 14. FIG. 13, on the other hand, relates to a comparable differential phase shifter assembly according to the invention with increased power distribution. The variant of FIG. 15 corresponds to the exemplary embodiment, which has already been explained with reference to FIGS. 4*a* and 4*b*.

The power distribution that is achievable, with regard to the inner or outer circular arc shaped striplines 5, according to the prior art is shown in the diagram of FIG. 16. The diagram of FIG. 15, on the other hand, describes the possible improved and increased power distribution according to the invention between the inner and the outer striplines 5, when a differential phase shifter assembly as explained with reference to FIG. 15 is used.

The power distribution that is achievable in the variant of FIG. 12, with regard to the outer stripline 5*a* and the so-called inner stripline 5*b* nearer to the pivot axis 7, 9, is shown in the diagram in FIG. 15.

The diagram of FIG. 15 indicates the power distribution between the two striplines 5*a* and 5*b* over the frequency range from 1.7 GHz to 2.7 GHz. The upper line in the diagrams in FIG. 16 describes the falling power share on the inner, stripline 5*b*, that is, closer to the pivot axis 7, 9, whereas the lower curve in the diagrams of FIG. 16 over the frequency range describes the power share that impinges on the outer stripline 5*a*, which is thus located farther away from the pivot axis 7, 9.

Corresponding relationships for an exemplary embodiment in FIG. 15 according to the invention are given in the diagram in FIG. 17. Here as well, the upper line describes the power share impinging on the inner stripline 5*b*, whereas the line drawn below it describes the frequency-dependent power share which impinges on the outer stripline 5*a*. It can be seen that within the scope of the exemplary embodiment according to the invention, with regard to the striplines 5*a* and 5*b*, a considerably larger power distribution is possible than with the embodiments according to the prior art.

The invention claimed is:

1. A differential phase shifter assembly comprising:

n striplines arranged concentrically with one another, on the oppositely located stripline ends of which connection points are provided for connecting lines leading to radiators, where n is a natural integer greater than or equal to 2, a feeding and/or tapping device which can be pivoted about a central and/or pivot axis and which is therefore pivotable over the plurality of striplines while establishing a primary capacitive coupling, a central feed which feeds the feeding and/or tapping device, at least one secondary capacitive coupling and a maximum of n−1 additional secondary capacitive couplings, the at least one or the plurality of secondary capacitive couplings is/are provided on the side of the feeding and/or tapping device opposite the primary capacitive coupling, and for the at least one additional secondary capacitive coupling at least one additional branched feeding and/or tapping device is provided, which together with the feeding and/or tapping device is pivotable about the central and/or pivot axis.

2. The differential phase shifter assembly according to claim 1, wherein the at least one additional branched feeding and/or tapping device is mechanically and electrically connected to the feeding and/or tapping device, either capacitively or galvanically.

3. The differential phase shifter assembly according to claim 1, wherein the secondary capacitive coupling has a first secondary coupling surface formed on the feeding and/or tapping device, which cooperates with a second secondary coupling surface, which is formed by the section of the stripline overlaid by the first secondary coupling surface at a distance therefrom, whereby an insulator, in the form of a fixed insulator, which is affixed to the branched feeding and/or tapping device or is held by it, is provided between the first and secondary coupling areas.

4. The differential phase shifter assembly according to claim 1, wherein the branched feeding and/or tapping device includes an angular attachment which mechanically holds the branched feeding and/or tapping device is on the feeding and/or tapping element and electrically feeds it.

5. The differential phase shifter assembly according to claim 1, wherein the branched feeding and/or tapping device includes a holding attachment or an indicator head which is situated in the area of the central and/or pivot axis parallel to an indicator head of the feeding and/or tapping device, and is mechanically held and galvanically or capacitively fed together with the indicator head.

6. The differential phase shifter assembly according to claim 1, wherein only a single additional secondary capacitive coupling is provided, by which an additional capacitive coupling is established only with regard to a single one of the plurality of striplines.

7. The differential phase shifter assembly according to claim 1, wherein the branched feeding and/or tapping device has m coupling surfaces, which with m striplines establish an additional capacitive coupling, where $m>1$ and $m<n$.

8. The differential phase shifter assembly according to claim 1, wherein the at least one branched feeding and/or tapping device is so constructed and positioned to establish at least one secondary capacitive coupling to a stripline closest to the central and/or pivoting axes.

9. The differential phase shifter assembly according to claim 8, wherein the at least one branched feeding and/or tapping device is so constructed and positioned to establish at least two capacitive couplings with at least two adjacent stripline.

10. The differential phase shifter assembly according to claim 1, wherein the at least one branched feeding and/or tapping device is so constructed and positioned to establish at least one capacitive coupling to the second or farther outwardly situated stripline, viewed from the central and/or pivot axis.

11. The differential phase shifter assembly according to claim 1, wherein at least two consecutive primary capacitive couplings with respect to the feeding and/or tapping device and/or at least two consecutive secondary capacitive couplings with respect to the branched feeding and/or tapping device are connected via a line section, which has a material section differing from the associated coupling surface and/or a differing width extent in the pivot direction.

12. The differential phase shifter assembly according to claim 1, wherein with respect to two adjacent striplines on the additional branched feeding and/or tapping device, at least one additional secondary capacitive coupling is provided for each.

13. The differential phase shifter assembly according to claim 1, wherein the additional branched feeding and/or tapping device runs over at least one stripline, forming a coupling-free or minimally coupled zone, and that at least one secondary capacitive coupling is provided which is farther away from the central or pivot axis with respect to the coupling-free or minimally coupled zone.

14. The differential phase shifter assembly according to claim 1, wherein at least two additional secondary capacitive couplings are provided, and that these at least two additional secondary capacitive couplings are held on a joint additional branched feeding and/or tapping device which carries them, whereby these at least two additional secondary capacitive couplings are allocated to two non-adjacent striplines, so that the additional branched feeding and/or tapping device runs over at least one coupling-free or minimally coupled zone) with respect to a stripline located between the two secondary capacitive couplings.

* * * * *